US006753091B2

(12) United States Patent
Huang

(10) Patent No.: US 6,753,091 B2
(45) Date of Patent: Jun. 22, 2004

(54) WAX DECORATION ITEMS AND METHOD MAKING THE SAME

(76) Inventor: Ming-Jen Huang, No. 8, St. 13, Lane 991, Ho-Ping Rd., Pa-Te City, Taoyuan Hsien (TW)

( * ) Notice: Subject to any disclaimer, the term of this patent is extended or adjusted under 35 U.S.C. 154(b) by 0 days.

(21) Appl. No.: 10/006,231

(22) Filed: Dec. 10, 2001

(65) Prior Publication Data

US 2003/0106674 A1 Jun. 12, 2003

(51) Int. Cl.[7] ..... F28F 13/18

(52) U.S. Cl. ..... 428/484.1; 165/134.1; 165/133

(58) Field of Search ..... 428/484.1, 304.4, 428/323; 165/134.1, 133; 106/10, 38.25, 38.8, 224, 230; 431/288

(56) References Cited

U.S. PATENT DOCUMENTS 3,560,122 A * 2/1971 Cassar ..... 431/288
3,565,819 A * 2/1971 Gragger ..... 264/4.4
3,615,620 A * 10/1971 Willems et al. ..... 430/602
5,078,747 A * 1/1992 Kastele et al. ..... 8/181
5,141,555 A * 8/1992 Elepano ..... 106/10
5,246,603 A * 9/1993 Tsaur et al. ..... 510/519

FOREIGN PATENT DOCUMENTS

JP 02-38449 * 2/1990 ..... C08L/69/00

* cited by examiner

*Primary Examiner*—Deborah Jones
*Assistant Examiner*—Vivek Koppikar
(74) *Attorney, Agent, or Firm*—Bacon & Thomas

(57) ABSTRACT

A wax decoration item is made by the method including the steps of mixing preparing polyethylene wax, cyanide polymer and white wax to be a mixture by way of heating; pouring the mixture in a mold and obtaining a wax item with fixed shape when removing the mold; melting a colloid material to be a transparent liquid and coating the colloid material onto an outer periphery surface of the wax item and the colloid material being not mixed with the wax item; condensing the colloid material which is fixed on the wax item.

9 Claims, 7 Drawing Sheets

WAX DECORATION ITEMS AND METHOD MAKING THE SAME

FIELD OF THE INVENTION

The present invention relates to a wax decoration item and a method for making the item wherein the item has a colloid outer layer which is not mixed with the wax of the decoration item.

BACKGROUND OF THE INVENTION

A conventional way to make a wax decoration item 51 in a colloid item 50 as shown in FIG. 1 has an inherent problem which is that the pigment for the wax decoration item 51 will be mixed with the colloid item 50. A mixture area 52 is presented around the wax decoration item 51. The other problem of the conventional way is shown in FIG. 2 and the problem is that the surface 53 of the wax decoration item 51 is melted so that the shape and color of the wax decoration item 51 cannot be sharply and precisely presented.

The present invention intends to provide a wax decoration item and a method for making the same. The was decoration item includes a colloid outer layer on the wax decoration item so as the present the desired shape of the wax decoration item.

SUMMARY OF THE INVENTION

In accordance with one aspect of the present invention, there is provided a method for making a wax decoration item and the method comprises the following steps:

step 1: preparing polyethylene wax, cyanide polymer and paraffin white wax;

step 2: mixing the polyethylene wax, cyanide polymer and white wax to be a mixture by way of heating;

step 3: pouring the mixture in a mold and obtaining a wax item with fixed shape when removing the mold;

step 4: melting a colloid material to be a transparent liquid;

step 5: coating the colloid material onto an outer periphery surface of the wax item and the colloid material being not mixed with the wax item, and step 6: condensing the colloid material which is fixed on the wax item.

The primary object of the present invention is to provide a method for making a wax decoration item wherein the colloid material fixed on the outer surface of the wax item is not mixed with the wax item.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
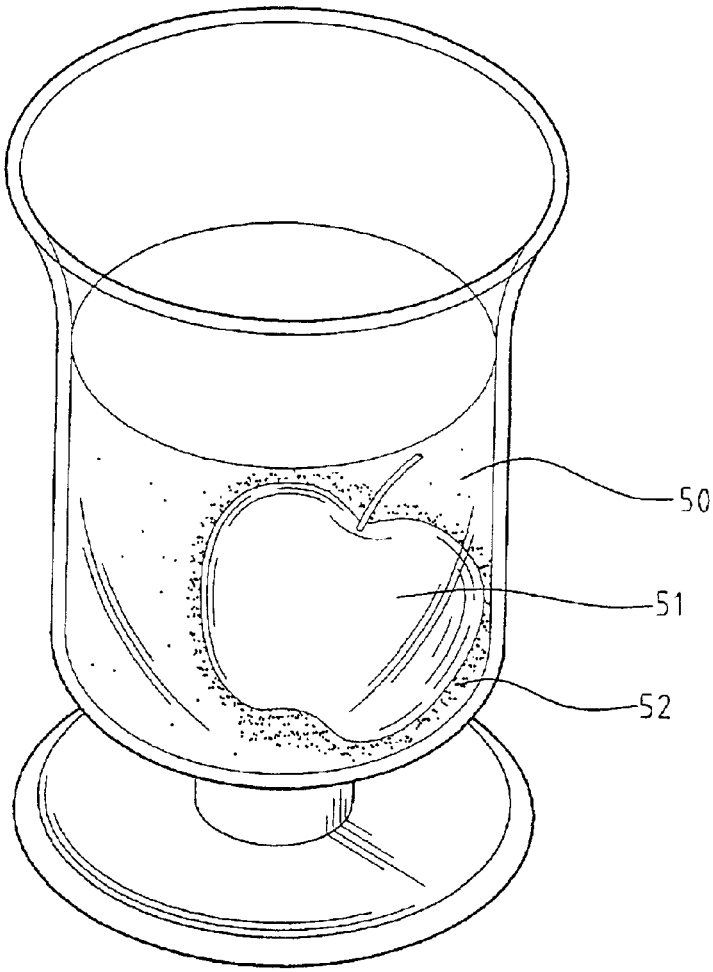
FIG. 1 (PRIOR ART)
FIG. 1 is a perspective view to show a conventional way to make a wax decoration item.
Figure 2:
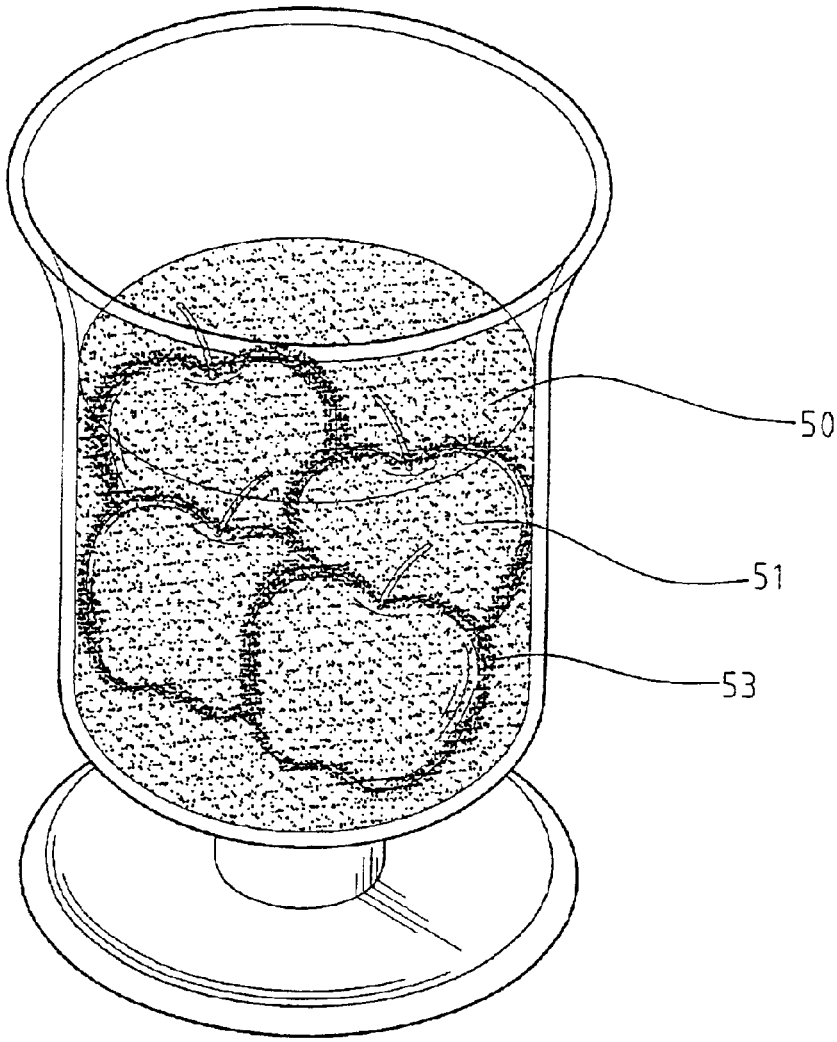
FIG. 2 (PRIOR ART)
FIG. 2 is a perspective view to show another conventional way to make a wax decoration item.
Figure 3:
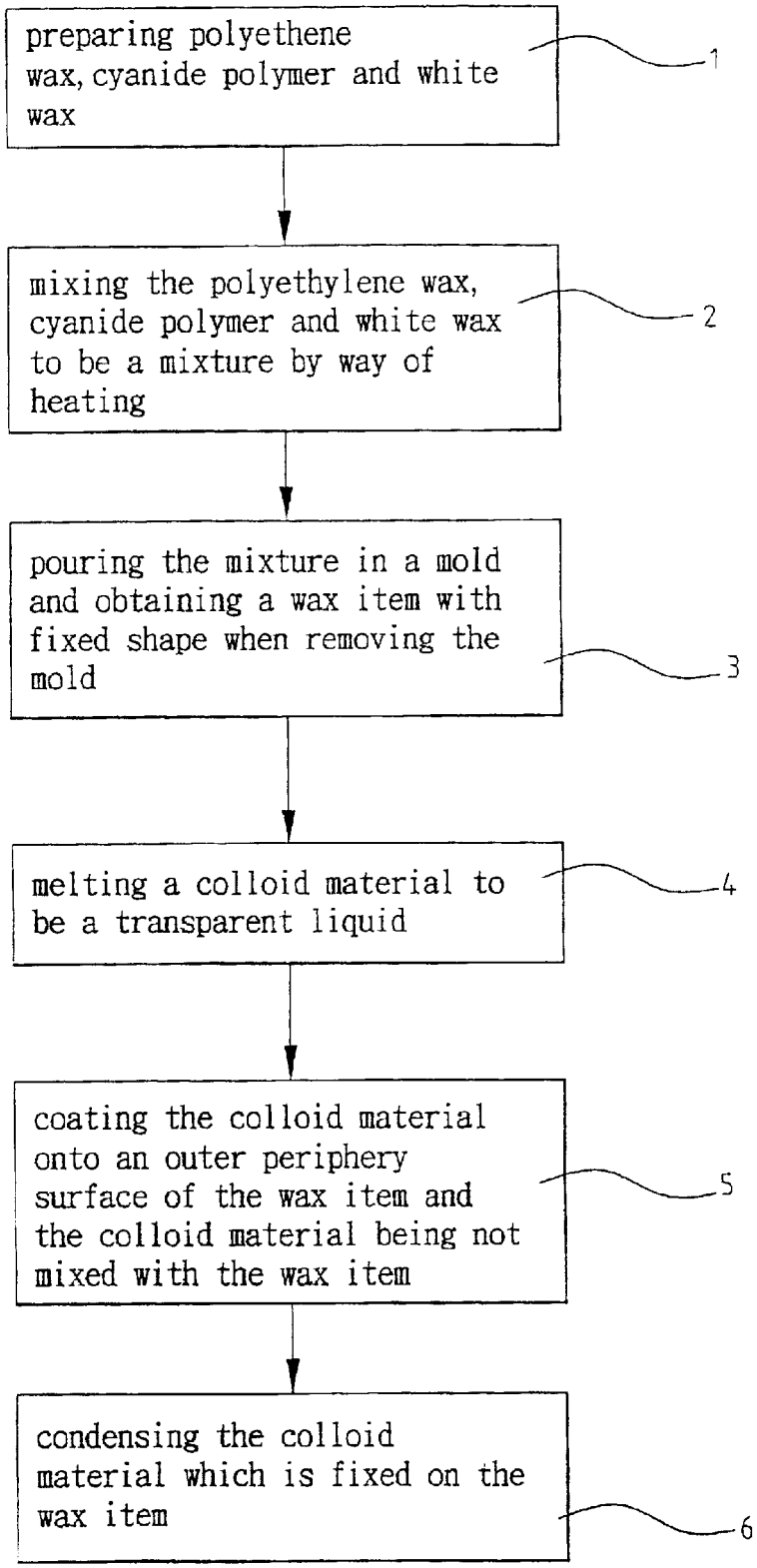
FIG. 3 is a flow chart to show the steps of the method of the present invention.

Referring to FIG. 3, the method for making a wax decoration item of the present invention comprises the following steps:

step 1: preparing polyethylene wax, cyanide polymer and white wax;

step 2: mixing the polyethylene wax, cyanide polymer and white wax to be a mixture by heating them;

step 3: pouring the mixture in a mold and obtaining a wax item 10 with fixed shape when removing the mold 30;

step 4: melting a colloid material 20 to be a transparent liquid;

step 5: coating the colloid material 20 onto an outer periphery surface of the wax item 10 and the colloid material 20 being not mixed with the wax item 10, and step 6: condensing the colloid material 20 which is fixed on the wax item 10.

The melting temperature and the condensing temperature of the colloid material 20 are lower than those of the wax item 10. The weight ratio between the polyethylene wax, the cyanide polymer and the white wax in steps 1 and 2 is 3–6%:7–11%:85–88%. The melting temperature and the condensing temperature are located in a range of 80–170 degrees Celsius. The preferred weight ratio between the polyethylene wax, the cyanide polymer and the white wax in steps 1 and 2 is 4.5%:9%:86.5%, the melting temperature and the condensing temperature being 125 degrees Celsius.

Figure 4:
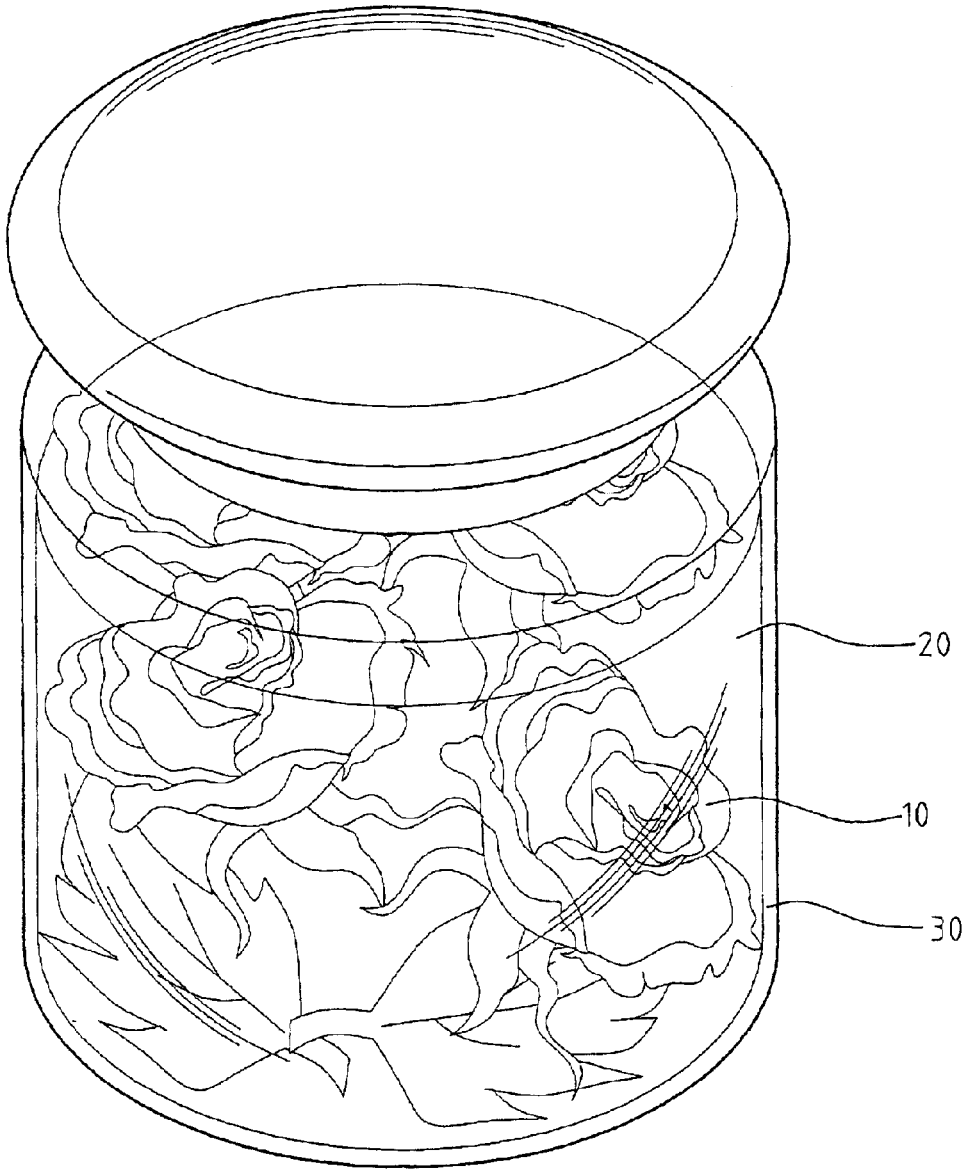
FIGS. 4 and 5 are a perspective view to show the wax decoration items of the present invention can be made to be different shapes.
Figure 5:
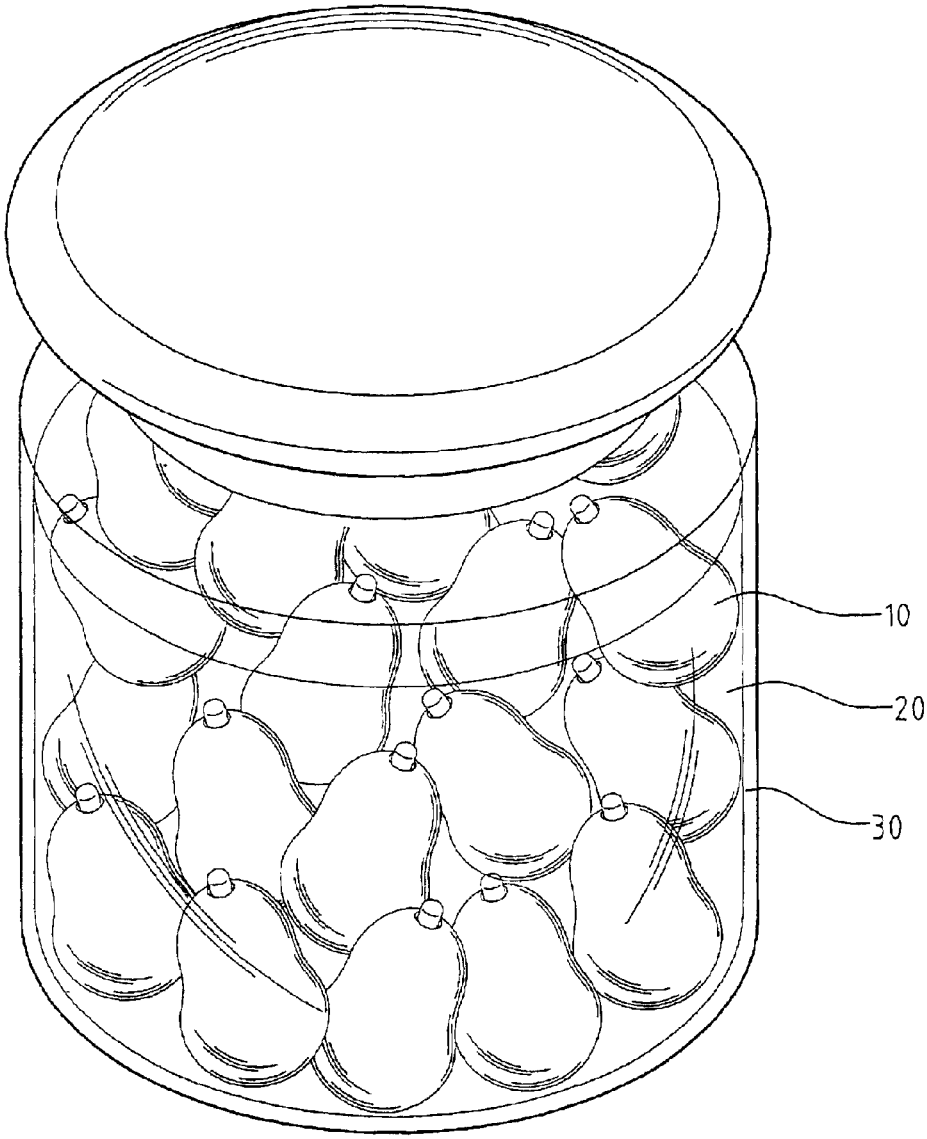

The shape of the wax decoration items 10 in step 3 can be different such as flowers as shown in FIG. 4 and fruits as shown in FIG. 5.

The colloid material 20 in step 4 is a mixture of the cyanide polymer and the white wax, and the weight ratio between the cyanide polymer and the white wax is 7–11%:89–93%. The melting temperature and the condensing temperature are located in a range of 75–140 degrees Celsius. The preferred weight ratio between the cyanide polymer and the white wax is 9%:91%, and the melting temperature and the condensing temperature are 120 degrees Celsius.

It is to be noted that inorganic pigment can be added in the mixture of the polyethylene wax, the cyanide polymer and the white wax in step 1 or 2. Also. The inorganic pigment can be added in the colloid material in step 4. Fragrance is added in the mixture in either step 1 or step 2. The fragrance can also be added in the colloid material 20 in step 4.

Figure 6:
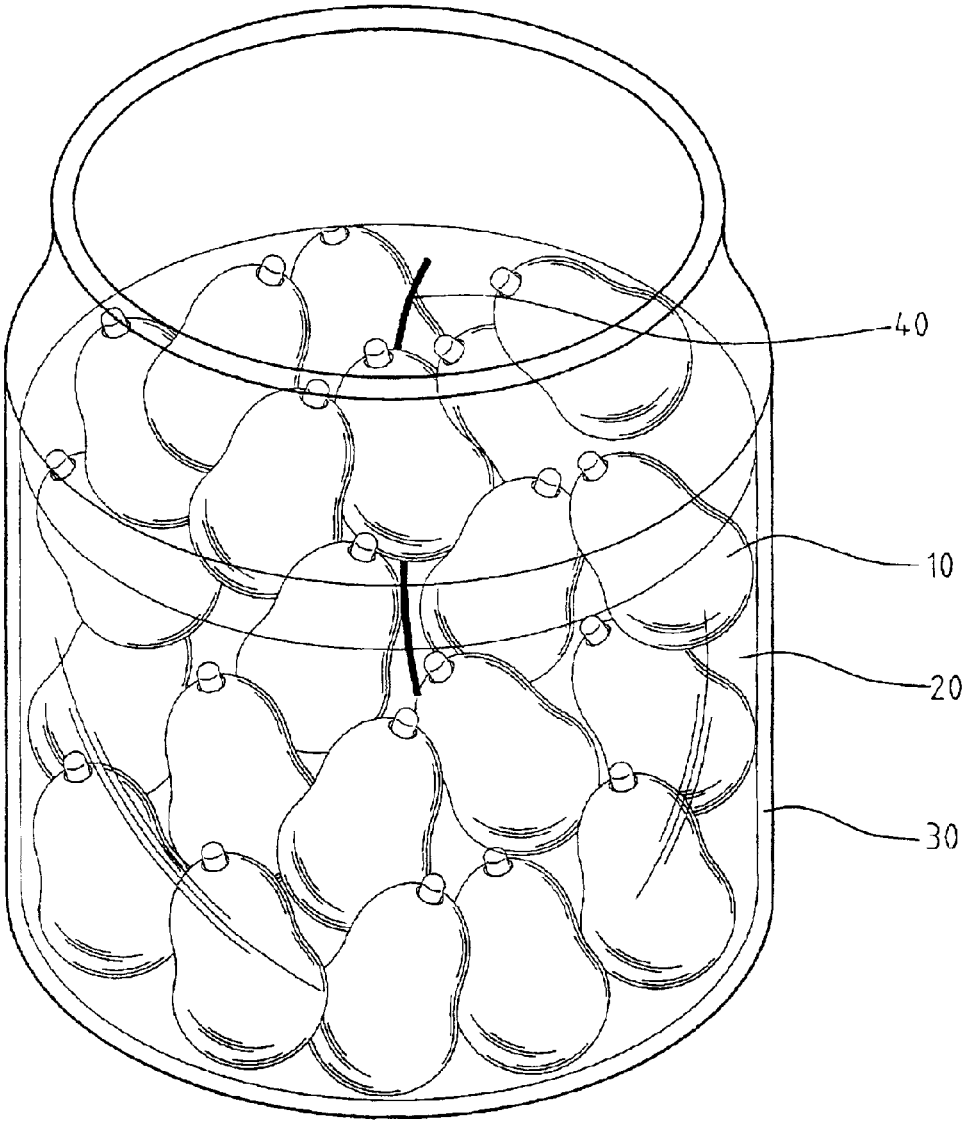
FIG. 6 is a perspective view to show a wick is connected to the wax decoration item of the present invention.

As shown in FIG. 6, the wax decoration item 10 may also be made to be a candle wherein a wick 40 is put in the wax item 10 in step 5 and the wick 40 extends out from the colloid material 20.

Figure 7:
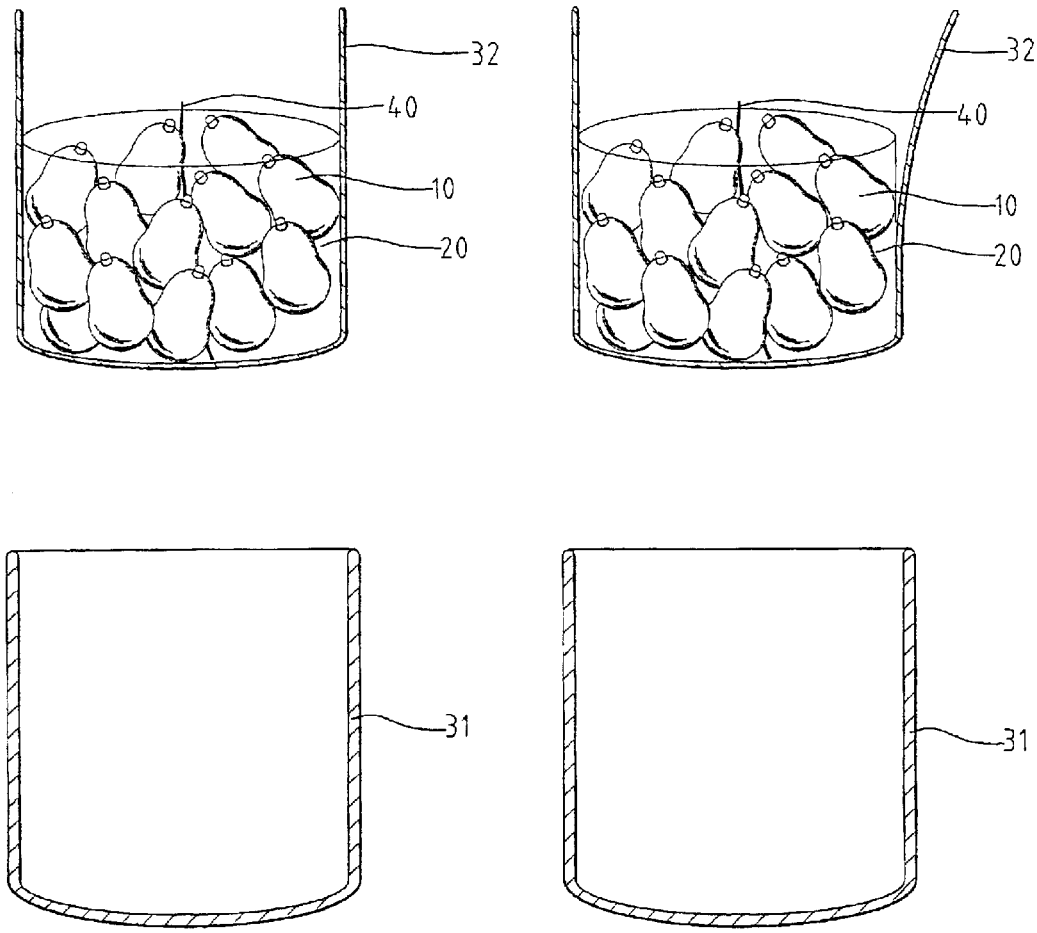
FIG. 7 shows a film is put in the inside of the mold and the wax decoration item of the present invention is put in the mold.

Referring to FIG. 7, a film 32 is put in an inside of a mold 31 in step 5 and the wax item 10 is put in the mold 31. The film 32 is peeled from the colloid material 20 after the colloid material 20 is cooled.

The colloid material 20 of the present invention will not mix with the outer surface of the wax decoration item 10 so that the shape of the wax decoration item 10 is sharp and precise.

While we have shown and described the embodiment in accordance with the present invention, it should be clear to those skilled in the art that further embodiments may be made without departing from the scope of the present invention.

What is claimed is:

1. A wax decoration item comprising a mixture of polyethylene wax, cyanide polymer and paraffin white wax; wherein the weight ratio between the polyethylene wax, the cyanide polymer and the white wax is 3–6%:7–11% 85–88%, the melting temperature and the condensing temperature located in a range of 80–170 degrees Celsius, wherein a colloid material is coated onto the outer peripheral surface of the wax decoration item and the melting temperature and the condensing temperature of the colloid material are lower than those of the wax decoration item.

2. The wax decoration item as claimed in claim 1, wherein the preferred weight ratio between the polyethylene wax, the cyanide polymer and the white wax is 4.5%:9%:86.5%, the melting temperature and the condensing temperature being 125 degrees Celsius.

3. The wax decoration item as claimed in claim 1, wherein the colloid material is a mixture of the cyanide polymer and the white wax, the weight ratio between the cyanide polymer and the white wax is 7–11%:89–93%, the melting temperature and the condensing temperature located in a range of 75–140 degrees Celsius.

4. The wax decoration item as claimed in claim 1, wherein the colloid material in step 4 is a mixture of the cyanide polymer and the white wax, the preferred weight ratio between the cyanide polymer and the white wax is 9%:91%, the melting temperature and the condensing temperature being 120 degrees Celsius.

5. The wax decoration item as claimed in claim 1, further comprising inorganic pigment added in the mixture of the polyethylene wax, the cyanide polyethylene wax, the cyanide polymer and the white wax.

6. The wax decoration item as claimed in claim 1, further comprising inorganic pigment added in the colloid material.

7. The wax decoration item as claimed in claim 1, further comprising fragrance added in the mixture of the polyethylene wax, the cyanide polymer and the white wax.

8. The wax decoration item as claimed in claim 1, further comprising fragrance added in the colloid material.

9. The wax decoration item as claimed in claim 1, further comprising a wick in the mixture of the polyethylene wax, the cyanide polymer and the white wax, the wick extending out form the colloid material.

* * * * *